US008455796B2

(12) United States Patent
Leung

(10) Patent No.: US 8,455,796 B2
(45) Date of Patent: Jun. 4, 2013

(54) HAIR STYLING IRON WITH RETRACTABLE FINS

(75) Inventor: Anthony Kit Lun Leung, North Point (CN)

(73) Assignee: Conair Corporation, Stamford, CT (US)

( * ) Notice: Subject to any disclaimer, the term of this patent is extended or adjusted under 35 U.S.C. 154(b) by 388 days.

(21) Appl. No.: 12/245,299

(22) Filed: Oct. 3, 2008

(65) Prior Publication Data

US 2009/0114240 A1 May 7, 2009

Related U.S. Application Data

(60) Provisional application No. 60/997,583, filed on Oct. 4, 2007.

(51) Int. Cl.

| | |
|---|---|
| ***A45D 1/04*** | (2006.01) |
| ***A45D 1/06*** | (2006.01) |
| ***A45D 2/40*** | (2006.01) |
| ***A45D 2/42*** | (2006.01) |

(52) U.S. Cl.
USPC ..... 219/225; 132/223; 132/225; 132/269

(58) Field of Classification Search
None
See application file for complete search history.

(56) References Cited

U.S. PATENT DOCUMENTS

| | | | | |
|---|---|---|---|---|
| 1,221,447 | A * | 4/1917 | Henderson | 132/118 |
| 4,739,151 | A * | 4/1988 | Smal | 219/225 |
| 5,848,599 | A * | 12/1998 | Todd | 132/221 |
| 6,223,753 | B1 * | 5/2001 | Lo | 132/224 |
| 6,941,955 | B2 * | 9/2005 | Yao | 132/225 |
| D516,242 | S * | 2/2006 | Habibi | D28/35 |
| 7,540,289 | B2 * | 6/2009 | Habibi | 132/224 |
| RE41,321 | E * | 5/2010 | Okumoto et al. | 132/224 |
| 2009/0114240 | A1 * | 5/2009 | Leung | 132/224 |

* cited by examiner

*Primary Examiner* — Joseph M Pelham
(74) *Attorney, Agent, or Firm* — Carter, DeLuca, Farrell & Schmidt, LLP

(57) ABSTRACT

A heated flat iron 1 includes a first elongated member 2 and a second elongated member 3 that are joined together at one end at a hinge 4. An electrical cord 5 is attached thereto and has a conventional plug (not shown) to connect the iron 1 to a conventional external electrical energy source. An upper plate 6 is attached to the first member 2, and a lower plate 7 us attached to the second member 3. The upper plate 6 comprises a longitudinally aligned groove 8, preferably including in the groove 8 a series of longitudinally spaced laterally oriented slot depressions 9. The lower plate 7 includes a set of raised ridges 10, each having a length L that is transverse to the longitudinal axis of the second member 3, a height H measured in a direction extending away from the surface of the lower plate 7, and a thickness T measured transversely to length L, where L is greater than T. The ridges 10 are aligned in a longitudinally extending row along the lower plate 7 so that the row is aligned with the groove 8 and each ridge 10 corresponds in alignment with one of the slot depressions 9. The height of the ridges 10 may be adjustably varied.

5 Claims, 4 Drawing Sheets

HAIR STYLING IRON WITH RETRACTABLE FINS

CROSS-REFERENCE TO RELATED APPLICATIONS

This application relates to and claims priority from U.S. Provisional Application No. 60/997,583 filed 4 Oct. 2007.

BACKGROUND OF THE INVENTION

The present invention relates to hair care appliances and, more particularly, to hair styling devices having heated plates.

DESCRIPTION OF RELATED ART

Various known hair styling irons have heated, flat plates. Certain flat irons have non-flat heated surfaces comprising one or more of raised contours, grooves, pins and channels. While each has a specialized purpose, such as shaping hair in a particular way, or detangling hair, none provide optimal performance for simultaneously straightening hair, detangling hair, and delivering optimum heat transfer. For example, designs that have mere pins or bristle-like protrusions effectively comb through hair, and in some instances detangle the hair, yet the pins are poor heat conductors and, therefore, do little to transfer heat. The result is that the heat transfer is almost entirely limited to surfaces of the flat iron that directly contact the hair. Furthermore, pins, particularly if a relatively large number are employed, have a tendency to get stuck in tangled hair and are difficult to pull through, particularly without causing discomfort.

OBJECT OF THE PRESENT INVENTION

It is an object of the present invention to provide a heated styling iron that achieves straightening, detangling, and optimum heat transfer in a manner that overcomes the shortcomings described above. It is another object of the present invention to provide a heated styling iron that is versatile and that can be configured into a plurality of modes for different styling functions.

These and other objects are achieved by the present invention disclosed herein.

SUMMARY OF THE INVENTION

According to the present invention, a heated styling iron having two opposed heated surfaces attached to respective members that are hingedly connected to each other achieves straightening, detangling and optimum heat transfer by utilizing on one flat heated surface a row of fin-like raised ridges that are spaced apart longitudinally in a single row and that are oriented so that the longer dimension of the fin-like ridges are aligned generally transversely to the longitudinal axis. Thus, as the iron is pulled through the hair the ridges guide the hair along their longer dimension. The opposing flat heated surface has a channel or groove that extends longitudinally in a manner so that it complementarily receives the row of ridges when the heated surfaces are closed against each other. The sizing and shape of the groove is optimized to receive the ridges while the heated surfaces are closing around a lock of hair. In another aspect of the invention, the raised ridges may be retractably mounted in order to be selectively retracted into or extended from the flat heated surface. The fins may be received into openings in the surface. The fins may be fixed at one or more heights for selective styling preferences. The fins may also be retracted fully to present a flush, smooth heated surface. Alternatively, the opposite flat heated surface may be formed without a channel or groove and the fins may be spring-biased so that, while initially raised, the fins will retract against the spring and flatten when pressed against the opposite surface. In another aspect of the present invention, a water reservoir and steam generator may be included with means for selectively controlling variable steam output level.

DESCRIPTION OF THE PREFERRED EMBODIMENT OF THE PRESENT INVENTION

Figure 1:
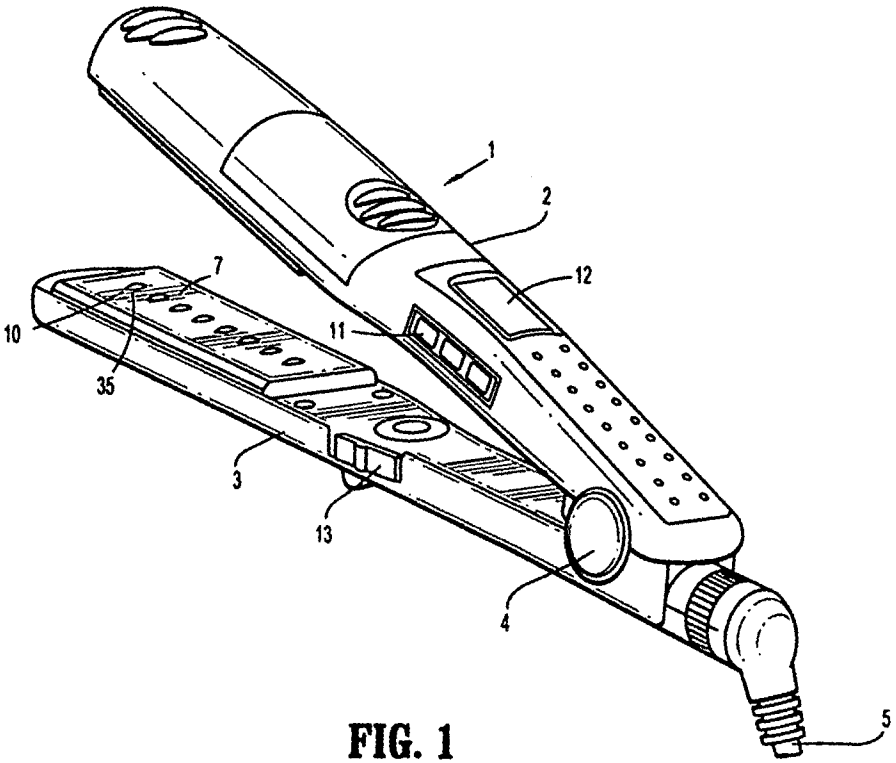
FIG. 1 is a perspective view of the hair styling iron in accordance with the principles of the present invention.
Figure 2:
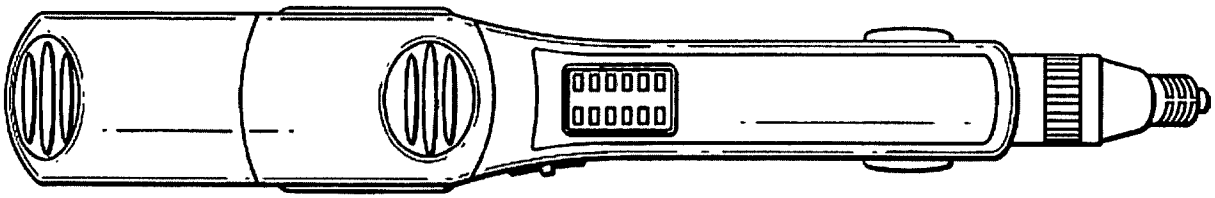
FIG. 2 is a top plan view of the hair styling iron.
Figure 3:
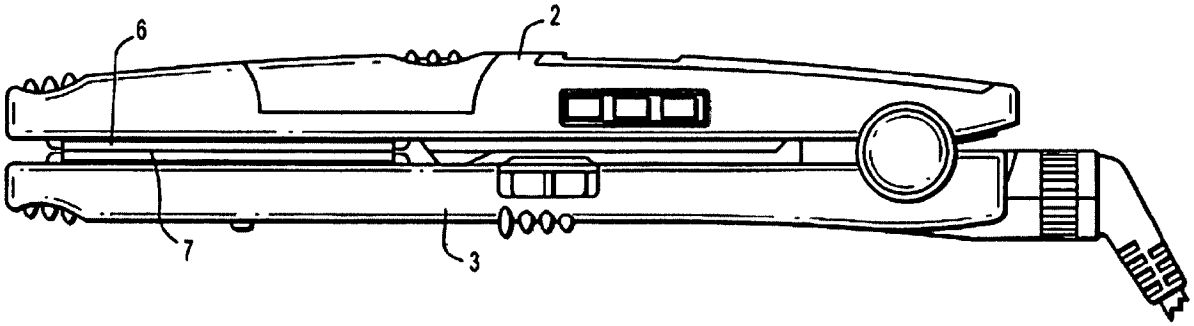
FIG. 3 is a side elevation view of the hair styling iron in a closed condition.
Figure 4:
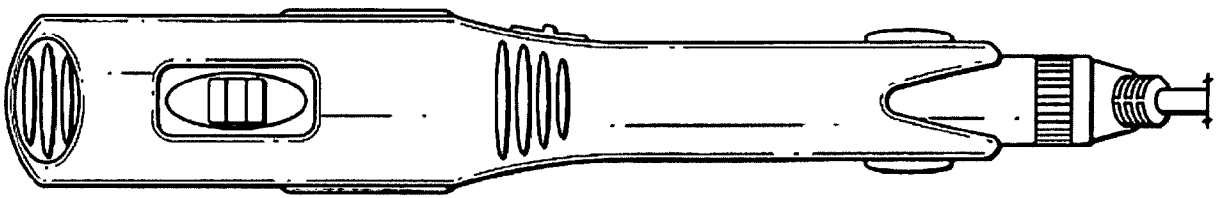
FIG. 4 is a top plan view of the hair styling iron.
Figure 5:
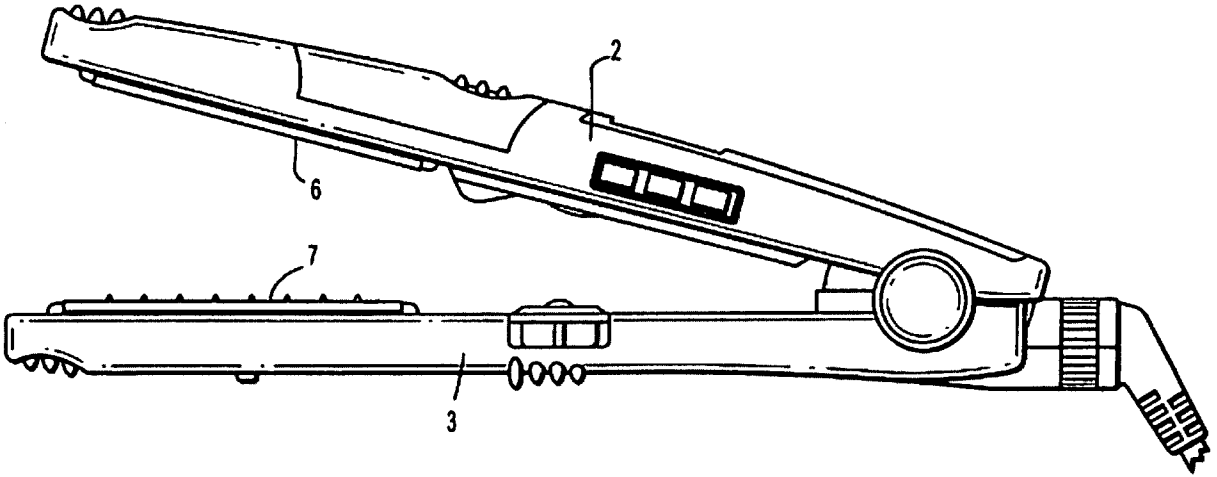
FIG. 5 is a side elevation view of the hair styling iron in an open condition.
Figure 6:
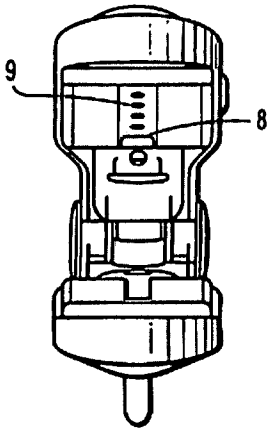
FIG. 6 is a front axial view of the hair styling iron in an open position condition.

Referring to the drawing figures, a heated flat iron 1 includes a first elongated member 2 and a second elongated member 3 that are joined together at one end at a hinge 4. An electrical cord 5 is attached thereto and has a conventional plug (not shown) to connect the iron 1 to a conventional external electrical energy source. An upper plate 6 is attached to the first member 2, and a lower plate 7 us attached to the second member 3. The upper plate 6 comprises a longitudinally aligned groove 8, preferably including in the groove 8 a series of longitudinally spaced laterally oriented slot depressions 9. The lower plate 7 includes a set of raised ridges 10, each having a length L that is transverse to the longitudinal axis of the second member 3, a height H measured in a direction extending away from the surface of the lower plate 7, and a thickness T measured transversely to length L, where L is greater than T. The ridges 10 are aligned in a longitudinally extending row along the lower plate 7 so that the row is aligned with the groove 8 and each ridge 10 corresponds in alignment with one of the slot depressions 9. Each ridge 10 is oriented so that its length L is transverse to the longitudinally extending row of ridges 10. The row of ridges 10 may be made on a secondary plate that is inlaid into or beneath the surface of the lower plate 7, or the ridges may be integrally formed therewith. If preferred, the slot depressions 9 could be eliminated in favor of simply a groove. Alternatively, an embodiment could have the ridges dispersed so that they do not form a single row, while maintaining the orientation of each ridge so that they are all parallel with respect to their L dimension. In such case, the opposing plate would have a wider groove or multiple grooves or depressions.

Conventional electric heat elements (not shown) as are known to those skilled in the art provide heat to either or both plates 6, 7. Conventional control buttons and dials are used to control heat settings. In the preferred embodiment, buttons 11 and display 12 are used to control the various functions such as on/off and temperature control. A lock element (not shown) of the type conventionally used in flat irons is controlled by a sliding lock switch 13. The various surfaces of the heated plates 6, 7 and the fins 10 may be made of metal or other suitable materials and may be treated or coated with one or more of ceramics, tourmaline, non-metals, metals, and other materials. Ion generators and infra red generators, including far infra red, may be incorporated into the iron. The iron may be vented for wet and dry applications, and it may have a steam generator and fluid reservoir to create on-demand steam. A variable steam output feature may be implemented to selectively control amounts or rates of steam emission, as opposed to merely having steam and no steam settings. A fan and heater may be included in the iron to selectively blow cool or heated air while styling.

Figure 8:
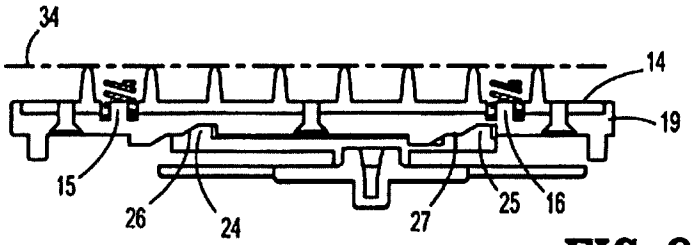
FIG. 8 is a side elevation view of the ridge base with the height varying mechanism arranged to position the ridges in a retracted position.
Figure 9:
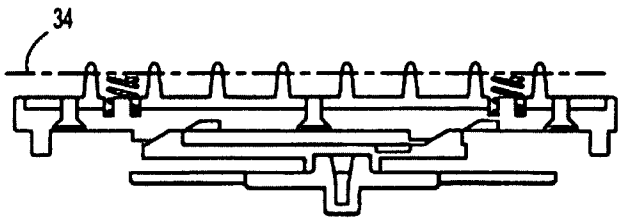
FIG. 9 is a view similar to the view of FIG. 8 illustrating the height varying mechanism arranged to position the ridges at a first height.
Figure 10:
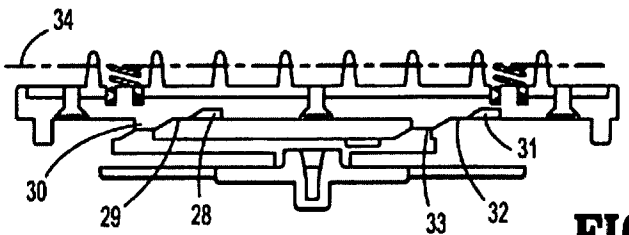
FIG. 10 is a view similar to the view of FIG. 8 illustrating the height varying mechanism arranged to position the ridges at a second height.
Figure 7:
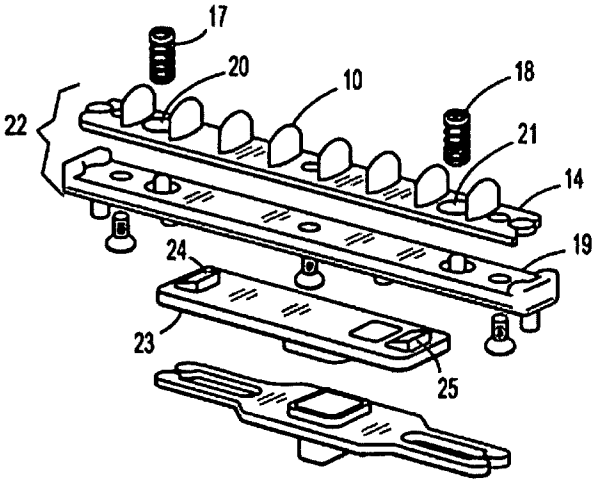
FIG. 7 is a perspective view with parts separated illustrating the ridge base and height varying mechanism for varying the height of the ridges.

Referring specifically to FIGS. 7-10, the raised ridges 10 are fixed to a base formed by an upper base body 14 and a lower base body 19 that has spring bosses 15, 16 to engage and retain springs 17, 18, respectively. The upper body 14 has holes 20, 21 to accommodate the springs and bosses as shown in FIGS. 8-10. The upper and lower base bodies 14, 19 are collectively referred to as the base 22. The base 22 is positioned in the second member 3 and arranged to that a wedge plate 23 can be moved to cause one or more wedges 24, 25 to engage corresponding contoured surfaces 26, 27 of the base 22. This adjusts the height of the ridges 10. The contoured surfaces 26, 27 each comprise three stepped levels 28-29-30 and 31-32-33, respectively, as shown in FIGS. 8-10. FIG. 8 illustrates the retracted or lower position where the wedges 24, 25 engage the respective first steps 28, 31. In this position, ridges 10 do not protrude past the surface of the plate 7, the surface being represented by line 34 in FIGS. 8-10. Thus, FIG. 8 represents the retracted position. FIG. 9 represents a low setting in which the ridges 10 protrude to a first height, as the wedge plate 23 is slid so that the wedges 24, 25 engage the respective second steps 29, 32. FIG. 10 represents a high setting in which the ridges 10 protrude to a second height, greater than the first height of FIG. 9, as the wedge plate 23 is slid so that the wedges 24, 25 engage the respective third steps 30, 33. The ridges 10 protrude through corresponding openings 35 in said lower plate 7. The springs 17, 18 bias the base 22 to return to the low and, finally, the retracted positions as the wedge 23 is slid back.

A fluid reservoir and steam generator (not shown) and a control system (not shown) to selectively and variably emit steam may be included so that a user can selectively apply steam during hair styling.

An alternative embodiment (not shown) may have the base and ridges spring biased to a fully extended height and capable of being depressed against the spring force to a minimal height or fully retracted position.

While the preferred embodiment of the present invention has been disclosed herein, it is understood that various modification can be made without departing from the scope of the presently claimed invention.

What is claimed is:

1. A hair straightening iron for styling hair, said iron comprising;

a first elongated member having a first heatable plate thereon and having a longitudinal axis;

a second elongated member having a second heatable plate thereon, said second heatable plate facing said first heatable plate;

a hinge at which said first member is joined to said second member in a pivotable relationship so that said first heatable plate and said second heatable plate can be opened and closed away from and toward each other, respectively; and a set of ridges extending orthogonally from said first heatable plate, each ridge comprising a length L, a width W, and a height H wherein L is greater than H and wherein each ridge is oriented with L perpendicular to said longitudinal axis; and a ridge base from which said ridges extend, said base being located beneath said first heatable plate and said ridges pass through corresponding openings in said first heatable plate.

2. An iron according to claim 1, wherein said ridges are arranged in a single row extending parallel to said longitudinal axis.

3. An iron according to claim 2, wherein said base is moveable in a direction perpendicular to said first heatable plate so that, when the base is moved, the height at which the ridges protrude past said first heatable plate is adjustable.

4. An iron according to claim 3, further comprising at least one wedge surface attached to said base; and a wedge plate having a wedge contact surface, said wedge plate being adapted to slide relative to said base so that said wedge contact surface engages and disengages said wedge surface of said base to cause said base to move in a direction perpendicular to said first heatable plate.

5. An iron according to claim 3, further comprising a plurality of wedge surfaces attached to said base; and a wedge plate having a wedge contact surface, said wedge plate being adapted to selectively slide relative to said base so that said wedge contact surface selectively engages and disengages one of said wedge surfaces of said base to cause said base to selectively move a desired amount in a direction perpendicular to said first heatable plate.

* * * * *